US010605132B2

(12) United States Patent
Aronsson

(10) Patent No.: US 10,605,132 B2
(45) Date of Patent: Mar. 31, 2020

(54) LUBRICATING SYSTEM, AN ENGINE AND METHOD FOR PROVIDING LUBRICANT TO AN ENGINE

(71) Applicant: HUSQVARNA AB, Huskvarna (SE)

(72) Inventor: Tore Aronsson, Mölndal (SE)

(73) Assignee: HUSQVARNA AB, Huskvarna (SE)

( * ) Notice: Subject to any disclaimer, the term of this patent is extended or adjusted under 35 U.S.C. 154(b) by 0 days.

(21) Appl. No.: 15/775,131

(22) PCT Filed: Nov. 12, 2015

(86) PCT No.: PCT/EP2015/076420
§ 371 (c)(1),
(2) Date: May 10, 2018

(87) PCT Pub. No.: WO2017/080601
PCT Pub. Date: May 18, 2017

(65) Prior Publication Data

US 2018/0320568 A1 Nov. 8, 2018

(51) Int. Cl.
*F01M 3/02* (2006.01)
*F01M 3/00* (2006.01)
(Continued)

(52) U.S. Cl.
CPC ..... *F01M 3/02* (2013.01); *F01M 1/02* (2013.01); *F01M 3/00* (2013.01); *F01M 11/02* (2013.01)

(58) Field of Classification Search
CPC .. F01M 3/02; F01M 1/02; F01M 3/00; F01M 11/02
See application file for complete search history.

(56) References Cited

U.S. PATENT DOCUMENTS 4,445,470 A 5/1984 Chmielewski
4,483,072 A 11/1984 Nagashima et al.
(Continued)

FOREIGN PATENT DOCUMENTS

FR 2531250 A1 2/1984
FR 2771448 A1 5/1999
(Continued)

OTHER PUBLICATIONS

International Search Report and Written Opinion for International Application No. PCT/EP2015/076420 dated Aug. 2, 2016, all enclosed pages cited.
(Continued)

*Primary Examiner* — Kevin A Lathers
(74) *Attorney, Agent, or Firm* — Burr & Forman LLP

(57) ABSTRACT

The invention relates to a lubricating system for an internal combustion engine (1). The system includes a first conduit means (7) connecting a lubricant supply source (5) to the internal combustion engine (1) for supplying lubricant to the internal combustion engine (1). According to the invention, the system further includes a second conduit means (8) connecting a gas supply source to the first conduit means (7) for supplying gas to the first conduit means such that gas bubbles are formed in the first conduit means (7). A sensor (3) detects whether lubricant or whether gas is present in a certain part of the first conduit (7). The certain part being located downstream the connection of the second conduit means (8) to the first conduit means (7). A control unit (6) is connected to the sensor (3), which control unit (6) is arranged to determine whether lubricant is flowing through the first conduit means (7) or not, in response to the detections of the sensor (3). The invention also relates to an internal combustion engine, to a power tool and to a method for providing lubricant to an internal combustion engine.

17 Claims, 4 Drawing Sheets

(51) Int. Cl.
*F01M 1/02* (2006.01)
*F01M 11/02* (2006.01)

(56) References Cited

U.S. PATENT DOCUMENTS

| | | | | |
|---|---|---|---|---|
| 5,829,395 | A * | 11/1998 | Brenny | F01M 3/02 123/73 AD |
| 6,318,332 | B1 | 11/2001 | Kern et al. | |
| 6,606,982 | B1 * | 8/2003 | Stockhausen | F01M 13/0011 123/572 |
| 2013/0291831 | A1 | 11/2013 | Schinkel et al. | |

FOREIGN PATENT DOCUMENTS

| | | | |
|---|---|---|---|
| GB | 2450719 | A | 1/2009 |
| JP | S6056114 | A | 4/1985 |
| JP | H03105008 | A | 5/1991 |
| JP | 2009180161 | A * | 8/2009 |
| WO | 2012084287 | A1 | 6/2012 |

OTHER PUBLICATIONS

International Preliminary Report on Patentability for International Application No. PCT/EP2015/076420 dated May 15, 2018, all enclosed pages cited.

* cited by examiner

LUBRICATING SYSTEM, AN ENGINE AND METHOD FOR PROVIDING LUBRICANT TO AN ENGINE

TECHNICAL FIELD

The present invention relates to an engine and more specifically to lubrication of engines. The teachings herein even more specifically relates to an engine comprising a lubrication system for lubricating the engine and a method for providing lubrication to the engine.

BACKGROUND

Internal combustion engines rely on a steady or regular supply of lubricant to ensure that moving parts of the engine does not overheat or get subjected to excessive wear. Power tools are often equipped with engines that are provided with lubricant along with the fuel. This is often achieved by mixing the lubricant into the fuel in advance. The supply of lubricant can however also be performed automatically by a pump providing lubricant to the engine from a separate lubricant supply. Since mixing lubricant and fuel manually to the right proportions can be difficult and purchasing premixed fuel/lubricant mixture is more expensive than buying the lubricant and fuel separately, an engine with an automatic lubrication system is often preferred.

However, when the lubrication is performed automatically by the engine, it is important that the lubrication system is reliable since the user is unable of controlling that the right amount of lubricant is provided to the engine.

It is known in the art (related background art can be found for instance in US20130291831A1) to provide a sensor for detecting if lubricant is present in a lubrication conduit; however merely detecting if lubricant is present has proven unreliable since standing oil may be interpreted as a flow of lubricant. Since flow sensors are considered too complex and are expensive, a reliable and cost effective way of ensuring that lubricant is flowing in a conduit is preferred.

SUMMARY

It is an object of the present invention to provide a lubrication system for an internal combustion engine and a method for providing lubricant to the engine that is improved over prior art. It is also an object of the invention to provide an engine including the invented lubrication system and a power tool using said engine which is improved over prior art. This object is achieved by a concept having the features set forth in the appended independent claims; preferred embodiments thereof being defined in the related dependent claims.

According to a first aspect of the invention the object is met in that a lubrication system of the kind specified in the preamble of claim 1 includes the specific features specified in the characterizing portion thereof. The lubrication system thus includes a first conduit means connecting a lubricant supply source to the internal combustion engine for supplying lubricant to the internal combustion engine. The system thus further includes the specific features that it includes a second conduit means connecting a gas supply source to the first conduit means for supplying gas to the first conduit means such that gas bubbles are formed in the first conduit means, a sensor detecting whether lubricant or whether gas is present in a certain part of the first conduit, which certain part is located downstream the connection of the second conduit means to the first conduit means, and a control unit connected to the sensor, which control unit is arranged to determine whether lubricant is flowing through the first conduit means or not, in response to the detections of the sensor.

According to a preferred embodiment of the invented lubrication system a pump is located in the first conduit means for pumping the lubricant.

According to a further preferred embodiment, the second conduit means is connected to a gas supply source that has a pressure which, at operation of the system, is at least intermittently higher than the pressure where the second conduit means is connected to the first conduit means.

According to a further preferred embodiment, the sensor is arranged to transmit a binary signal to the control unit, which signal varies depending on whether gas or whether lubricant is present in said certain part.

According to a further preferred embodiment, the signal is an alternating signal if lubricant is present and a constant signal if gas is present, or vice versa.

According to a further preferred embodiment, the second conduit means comprises a check valve arranged to allow flow through the second conduit means only in the direction towards its connection to the first conduit means (7).

According to a further preferred embodiment, the first conduit means comprises a check valve downstream of the pump that allows flow only in the direction from the pump toward the check valve.

According to a further preferred embodiment, the sensor is an optical or a capacitive sensor.

According to a further preferred embodiment, the control unit is arranged to determine whether lubricant is flowing through the first conduit means at a flow rate within a predetermined range or not, in response to the detections of the sensor.

According to a further preferred embodiment, a user interface is connected to the control unit for alerting a user that flow of lubricant has stopped.

According to a further preferred embodiment, the user interface is arranged to alerting the user that flow of lubricant is outside a predetermined range for the flow rate.

According to a further preferred embodiment, at least one of the first conduit means and the second conduit means includes a restriction arranged to facilitate and control the formation of bubbles in the first conduit means.

According to a second aspect of the invention, the object is met in that an internal combustion engine includes the invented lubricating system, in particular according to any of the preferred embodiments thereof.

According to a preferred embodiment of the invented internal combustion engine, the control unit is arranged to perform an action, if it determines that the flow of lubricant has stopped, the action being one or several of:

- indicating that the flow of lubricant to the engine has stopped,
- restricting engine power output,
- stopping the engine.

According to a further preferred embodiment, the control unit is arranged to perform an action, if it determines that the flow of lubricant is outside a predetermined flow rate, the action being one or several of:

- indicating that the flow of lubricant to the engine is outside said range,
- restricting the engine power output,
- stopping the engine.

According to a further preferred embodiment, the second conduit means is connected to an intake of the engine as the gas supply source.

According to a further preferred embodiment, the first conduit means is connected to an intake of the engine for the supply of lubricant.

According to a further preferred embodiment, the intake of the engine comprises a venturi, and the first conduit means is connected to the venturi or to a position adjacent the venturi.

According to a further preferred embodiment, the first conduit means is connected to a narrow part of the venturi.

According to a further preferred embodiment, an intake of the engine comprises a throttle valve.

According to a further preferred embodiment, the throttle valve is positioned downstream of the venturi in relation to the flow direction in the intake.

According to a further preferred embodiment, the second conduit means is connected to the intake upstream of the throttle valve.

According to a further preferred embodiment, the second conduit is connected to the intake downstream of the throttle valve According to a third aspect of the invention it relates to a power tool comprising the invented internal combustion engine, in particular according to any of the preferred embodiments thereof.

According to a preferred embodiment of the invented power tool, the tool is a cut-off saw, a chain saw, a hedge cutter, a lawn mover or a trimmer. According to a fourth aspect of the invention it relates to a method for providing lubricant to an internal combustion engine and includes the specific steps specified in the characterizing part thereof: The method thus includes providing lubricant from a lubricant supply source via a first conduit means (7) to the engine. The specific steps of the invention are:

- providing gas to the first conduit means via a second conduit means such that intermittent gas bubbles form in the first conduit means,
- using a sensor detecting whether lubricant or whether gas is present in a certain part of the first conduit means, which certain part is located downstream of the supply of gas from the second conduit means to the first conduit means,
- determining by a control unit connected to the sensor if lubricant is flowing through the first conduit means or not, in response to the detections of the sensor.

According to preferred embodiments of the invented method, the method is adapted to provide lubricant to an internal combustion engine according to the present invention, in particular according to any of the preferred embodiments thereof. These preferred embodiments of the method thus include the corresponding steps that are implied by the preferred embodiments of the internal combustion engine.

According to a further preferred embodiment, the method includes the step of evacuating lubricant from the first conduit means with the aid of the gas from the second conduit means if flow of lubricant stops such that the sensor only detects gas in the first conduit.

BRIEF DESCRIPTION OF THE DRAWINGS

Embodiments of the invention will be described in further detail in the following with reference to the accompanying drawings which illustrate non-limiting examples on how the embodiments can be reduced into practice and in which.

DETAILED DESCRIPTION OF EMBODIMENTS

Figure 1:
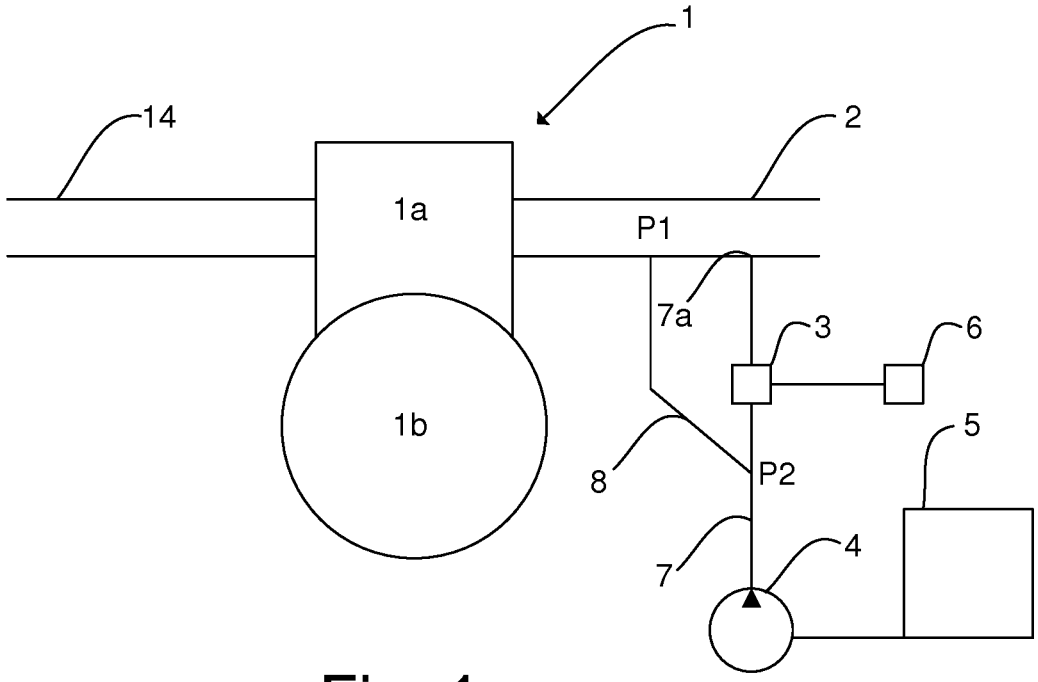
FIG. 1 shows a method according to one embodiment according to the invention.

With reference to FIG. 1, a simplified illustration of an engine 1 comprising a lubrication system according to the teachings herein is shown. For simplicity, a single cylinder engine 1 is shown however the lubrication system can equally well be applied to an engine configuration comprising a plurality of cylinders. The engine comprises a cylinder block 1*a*, which comprises the cylinder(s) and the reciprocating piston(s) of the engine 1. The engine further comprises a crankcase 1*b*, onto which the cylinder block 1*a* is attached.

The engine comprises at least one intake 2, for supplying air and fuel mixture to engine 1. The intake may also be used for supplying lubricant to the engine 1 along with the fuel/air mixture, which is often the case with 2-stroke and even some 4-stroke engines. This is especially common in engines being adapted for use in power tools.

The engine further comprises at least one exhaust 14, which transport exhaust gases from the cylinder(s) of the engine 1.

The engine 1 comprises a lubrication system, which provides lubrication to the engine 1 through a first conduit 7. The lubricant provides lubrication to the moving parts in the engine 1, for preventing overheating, excessive wear and eventual seizing of the engine 1. The first conduit 7 is connected to a lubricant supply 5, such as a reservoir or a sump. A pump 4 is provided which pumps lubricant from the supply 5 to an outlet 7*a* of the first conduit 7. Furthermore, a sensor 3 is provided for detecting presence or absence of lubricant (i.e. detecting presence of gas) in the first conduit 7 downstream of the pump 4.

A second conduit 8 is provided which connects to the first conduit 7 downstream of the pump 4, between the pump 4 and the sensor 3. The second conduit 8 provides gas to the first conduit 7, such that intermittent gas bubbles form in the first conduit 7. Gas may include any of air, air-fuel mixture or air-fuel-lubricant mixture, which is capable of forming bubbles in the lubricant flow in the first conduit 7. The bubbles will be transported along with the lubricant in the first conduit 7 to the outlet 7*a* of the first conduit 7, thereby flowing past the sensor 3.

The embodiments herein are for simplicity described with one first conduit 7 and one second conduit 8; however, a plurality of first conduits 7 and/or a plurality of second conduit 8 may equally well be used. For instance the first conduit 7 may be separated into two or more conduits downstream of the connection of the second conduit 8 to the first conduit 7, thus enabling provision of lubricant to e.g. both the intake and the crank case of the engine 1. A plurality of second conduits 8, i.e. conduits for provision of gas to the first conduit may also be used for redundancy etc.

As is illustrated, the first 7 and second conduit 8 of the lubrication system may be connected to the intake 2 of the engine 1; however the conduits 7, 8 may be connected elsewhere as well. For instance, the first and/or the second conduit(s) may be connected to the crankcase 1*b* of the engine 1. The first and second conduits may be separate conduits 7, 8 not being an integral part of the engine 1, such as hoses or tubes. However, the conduits 7, 8 may equally well be cast or formed as internal conduits 7, 8 of the engine 1 or in a component of the engine 1 such as a carburetor. The second conduit 8 may also provide gas (i.e. air in this case) to the first conduit 7 from the surrounding of the engine 1, in which case an air filter may be provided to prevent debris from entering the second conduit 8.

The sensor 3 detects a pattern of alternating lubricant and gas (absence of lubricant) that flows past it, which may include duration of each passage lubricant or gas. An alternating pattern indicates that lubricant is flowing and the duration between two gas bubbles can be used to determine for instance that lubricant is being provided in a sufficient amount or not.

The gas is provided from the second conduit 8 into the first conduit 7 by a pressure difference between a first pressure P1 acting where one end of the second conduit 8 connects and a second pressure acting P2 in the first conduit 7 where the other end of the second conduit connects, P1 being at least intermittently higher than P2. The intermittent i.e. alternating pressure difference is preferably generated by the operation of the engine 1, providing an intermittent stream of gas to the first conduit 7 while the engine 1 is operating and lubricant is being provided by the pump 4 to the engine 1.

The sensor 3 is provided to detect lubricant in the first conduit 7, between the pump 4 and the outlet 7*a* of the first conduit 7, downstream of the connection of the second conduit 8 to the first conduit 7. The sensor 3 may be a binary sensor, providing a binary signal indicating lubricant or no lubricant (i.e. presence of gas) in the first conduit 7. An example of such a binary sensor 3 may be an optical sensor or a capacitive sensor or other similar sensors that are well suited for providing a binary signal and for detecting fluid such as lubricant in a conduit.

The sensor 3 is connected (directly or indirectly) to an engine control unit 6, which is configured to interpret the signals from the sensor 3 and to determine if provision of lubricant is functioning or if provision of lubricant is disrupted. The intermittent gas bubbles that are formed in the flow of lubricant through the first conduit 7 will function as an indication that lubricant is being provided to the engine 1. As long as the signal from the sensor 3 to the control unit 6 varies between lubricant and no lubricant (gas), flow of lubricant can be determined by the control unit 6 to be present. When the signal from the sensor 3 to the control unit 6 remains constant for a prolonged period of time, this will indicate that flow of lubricant is disrupted. Due to the capillary pressure in the first conduit 7, the bubbles will be transported by the pumping of lubricant and thus is the orientation of conduits 7, 8 not of high importance. If the pump 4 stops working while the engine 1 continues to operate, the pressure difference between P1 and P2 will ensure that the gas provided from the second conduit 8 into the first conduit 7 will evacuate the lubricant downstream of the second conduit 8 connection to the first conduit 7.

Figure 2:
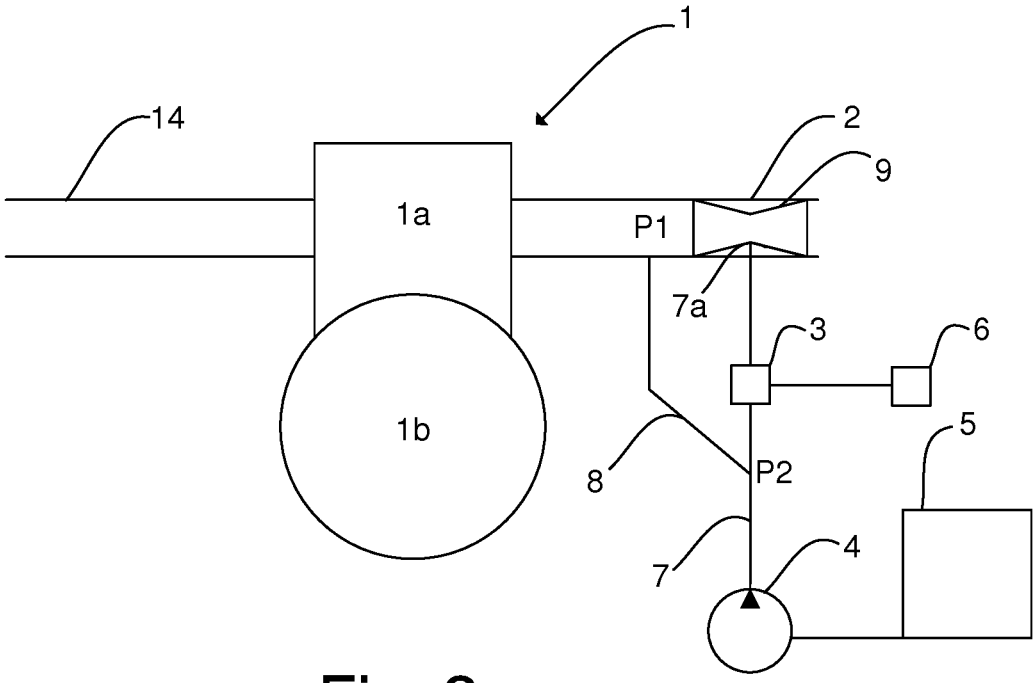
FIG. 2 shows an engine comprising a lubrication system according to a second embodiment.

In FIG. 2, an engine 1 is shown comprising a lubrication system according to one embodiment of the teachings herein. The engine 1 further comprises a venturi 9 or a narrowing portion 9 in the intake 2. The first conduit 7 may be connected in or adjacent to the venturi 9 or even in the narrowest part of the venturi 9 where the low pressure and high velocity of the flow will distribute the lubricant efficiently into the gas which flows through the intake 2. As is shown, the second conduit 8 may connect to the intake 2 downstream of the venturi 9. However, the second conduit 8 may also be connected upstream of the venturi in the intake 2 or even directly to the surrounding environment.

The first and/or second conduits 7, 8 may also be connected to other parts of the engine 1. For instance, connecting the first and/or the second conduits 7, 8 to the crankcase is also possible.

Figure 3:
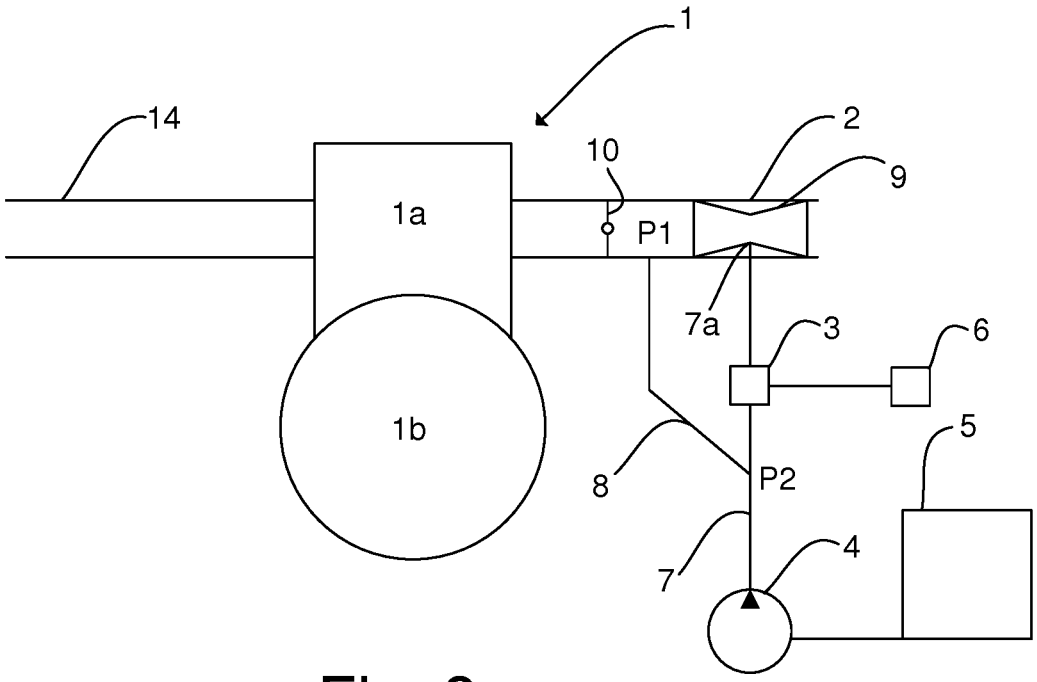
FIG. 3 shows an engine comprising a lubrication system according to a third embodiment

As is shown in FIG. 3, a throttle valve 10 may be provided in the intake 2. The throttle valve regulates the flow in the intake 2. The throttle valve 10 is shown in combination with an upstream venturi 9, however the throttle valve 10 may equally well be provided in an intake 2 without a venturi 9 or with a venturi 9 downstream of the throttle valve 10. The first and/or second conduit 8 may connect upstream or downstream of the throttle valve 10.

Figure 4:
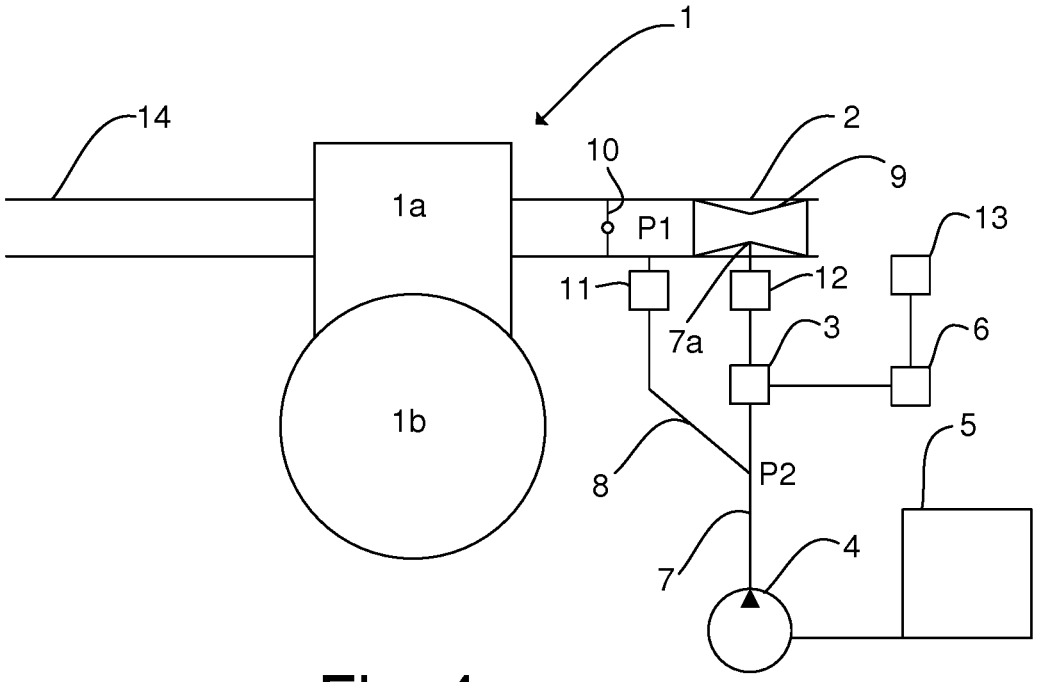
FIG. 4 shows an engine comprising a lubrication system according to a fourth embodiment.

As is shown in FIG. 4, one or both of the conduits 7, 8 may comprise a check valve 11, 12. The check valve 12 in the first conduit 7 prevents the flow from reversing and overpowering the pump 4. The risk of reverse flow increases when no venturi is present in the intake 2, resulting in a higher pressure for the pump 4 to overcome when pumping lubricant into the intake 2.

The check valve 11 in the second conduit 8 will ensure that flow of gas only occurs in one direction. Furthermore, it is ensured that no lubricant provided by the pump 4 flows into the second conduit 8. The provision of check valves 11, 12 allow larger freedom in placing the conduit 7, 8 connections and makes the lubrication system more robust. The conduits 7, 8 may for example be connected directly to the crankcase as long as the requisite regarding the pressure P1 being intermittently higher than P2 is fulfilled.

When a disruption in the lubrication to the engine 1 occurs, it is important that the user is made aware of this as soon as possible. In this purpose and to prevent damaging of the engine 1, a restriction of the power outlet of the engine 1 may be implemented as an action by the control unit 6. This may be achieved by altering ignition and/or restricting flow of fuel to the engine 1. The ignition may be altered by for instance by omitting sparks and thereby restricting the engine from running at high speeds (RPM). This alone will in most applications suffice as a way of alerting a user of a problem with the lubrication. However, a user interface 13, possibly comprising light emitting diodes, lamps, screens and/or audible signaling, may also be provided which will further clarify to the user that a lubrication problem has occurred. The user interface 13 being connected (directly or indirectly) to the control unit 6, which may activate the user interface 13 when the control unit 6 determines that provision of lubricant has been disrupted.

Figure 5:
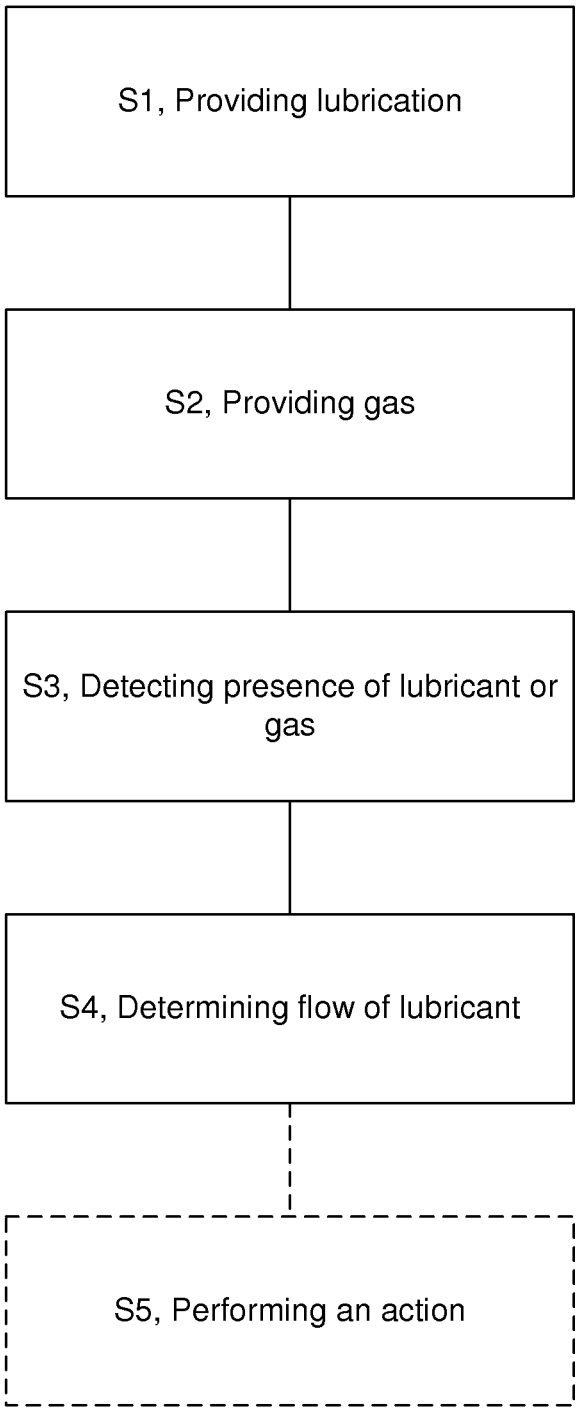
FIG. 5 shows a diagram illustrating the steps of a method according to an embodiment of the invention for lubricating an internal combustion engine.

With reference to FIG. 5, a method for providing lubricant to an engine 1 is presented. The method comprises providing S1 lubricant by the pump 4 from the lubricant supply 5 via the first conduit 7 to the engine 1, providing gas S2 to the first conduit 7 via a second conduit 8 such that intermittent gas bubbles form in the first conduit 7, detecting S3 if lubricant or gas is present in the first conduit by the sensor 3 and determining S4 by the control unit 6 connected to the sensor 3 if lubricant is flowing through the first conduit. S1 to S4 are performed continuously as the engine 1 is operating and the sequence will initiate when the engine 1 starts.

The engine 1 being an internal combustion engine 1, more specifically an internal combustion engine 1 which is provided with lubrication from a separate lubrication system.

The provision S1 of lubricant to the engine 1 is performed by the lubrication pump 4.

The provision S2 of gas to the to the first conduit 7 via the second conduit 8 in order to generate intermittent gas bubbles in the first conduit 7 is achieved by a pressure difference between a first pressure P1 acting where one end of the second conduit connects and a second pressure P2 acting in the first conduit 7 where the other end of the second conduit 8 connects, P1 being at least intermittently higher than P2. The pressure fluctuations between P1 and P2 may occur due to the operation of the engine 1. As long as the prerequisite that the pressure P1 is intermittently higher than P2 is fulfilled, the positions of the connections of the first and second conduit can vary. Since P1 is intermittently higher than P2, gas will be transported into the first conduit 7 and form intermittent bubbles which are detectable S3 by the sensor.

As a result of the providing of intermittent gas into the first conduit 7, the sensor 3 will detect an alternating pattern of lubricant and gas over time for as long as the engine 1 and the lubrication system are operating as intended. Thus can the control unit 6 determine S4 that as long as the sensor 3 detects and transmits an alternating binary pattern, lubrication is being provided to the engine 1. Should a prolonged period of only lubricant or only gas be detected, i.e. the sensor 3 generating a prolonged constant signal, this would indicate to the control unit 6 that the lubrication system is disrupted. If the periods of lubricant passing past the sensor 3 are too brief, this could also be indicating that the engine 1 is not receiving enough lubricant. Thus is both the longevity of each passing of lubricant or gas past the sensor 3 important as well as the number of lubricant/gas alternations per time unit.

The amount of gas bubbles (i.e. number of alterations between gas and lubricant) which forms in the first conduit 7 depends on several factors. Examples of such factors are fluctuations in the pressure difference between P1 and P2, the relative dimensions of the first and second conduits 7, 8 and the amount of lubricant which is being pumped by the pump 4 to name a few. The first 7 and/or the second conduit 8 may comprise restrictors to facilitate and control the formation of bubbles in the first conduit 7.

As an engine 1 has varying demands on lubrication depending on the operating conditions, the lubrication system may be configured to only detect alternations between lubricant and gas during operation above certain RPM speeds or at certain throttle positions etc. For instance, during engine idle speeds, the engine 1 will manage extended periods without being provided with lubricant. And since the pressure fluctuations between P1 and P2 during idle engine speeds may be insufficient for producing gas bubbles in the first conduit 7, detection of lubricant or gas by the sensor 3 may therefore be paused or aborted during engine 1 idle speed. Examples of such operating conditions may thus be the RPM of the engine 1 dropping below a predetermined RPM and/or closed throttle position etc. The lubrication pump 4 may also be configured to reduce provision of lubricant to the engine 1 during such operating conditions, either completely or to a certain extent.

Furthermore, the gas which is provided through the second conduit 8 into the first conduit 7 may evacuate the lubricant in the first conduit 7 in case of a pump 4 failure or other disruption to the lubrication system. This leads to the control unit 6 being able to separate a blockage in the second conduit 8 (prolonged period of only lubricant detected by the sensor 3) from a disruption in the providing of lubricant (prolonged period of only gas/no lubricant detected by the sensor 3).

When the control unit 6 determines that a disruption in the lubrication system is present, the performing an action S5 may be initiated by the control unit 6. The action may be one or both of (i) indicating to the user that the flow of lubricant to the engine has stopped and (ii) restricting engine power output. The action may also comprise (iii) shutting down the engine 1, for instance if the user does not shut it down manually in a certain time period after the power output has been reduced and the indication has been activated. The indication to the user may be performed by the user interface 13, which will further clarify to the user that a lubrication problem has caused the power of the engine 1 to be restricted.

The power outlet of the engine 1 is preferably restricted to such an extent that the power tool to which the engine 1 is mounted is rendered unusable, for instance by not allowing the engine 1 to exceed an RPM (revolution speed) required for engaging an engagement clutch, such as a centrifugal clutch, for engaging the tool.

Figure 6:
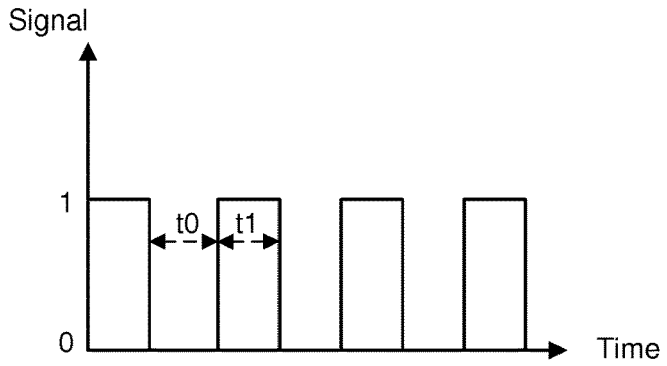
FIG. 6 shows a first time line diagram of the signal from the sensor.

Turning to FIGS. 6 to 9, various time-line diagrams of the signal from the sensor 3 is shown. In FIG. 6, the binary signal is shown alternating relatively regularly between 1 (indicating lubricant) and 0 (indicating gas). T0 denotes the duration of each passing of gas and t1 denotes the duration of each passing of lubricant. The duration of t0 and t1 may be performed by measuring time (e.g. seconds or milliseconds) and/or by counting the number of engine 1 revolutions per passing of gas/lubricant or between two lubricant passes. As the engine 1 RPM may also be a factor for the amount of lubricant that needs to be provided to the engine 1, it may be beneficial to weigh this in when the control unit 6 determines whether sufficient lubricant is flowing. The diagram in FIG. 6 indicates a functioning lubrication system.

Figure 7:
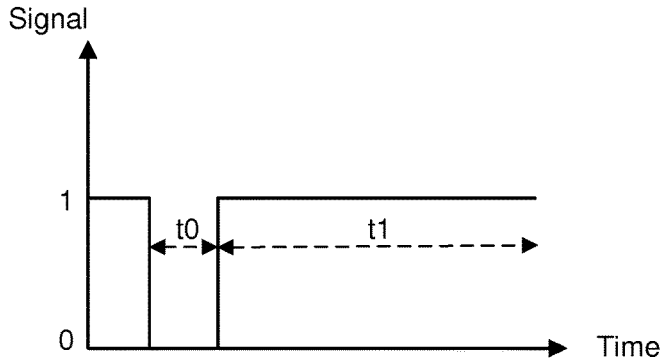
FIG. 7 shows a second time line diagram of the signal from the sensor.

In FIG. 7 the provision of gas has been disrupted, leading to only lubricant being detected by the sensor 3. Since this situation creates an uncertainty in the detection of flow of lubricant to the engine 1, the control unit 6 may be arranged to indicate this by performing an action such as alerting the user by the user interface 13 or by restricting power outlet of the engine 1.

Figure 8:
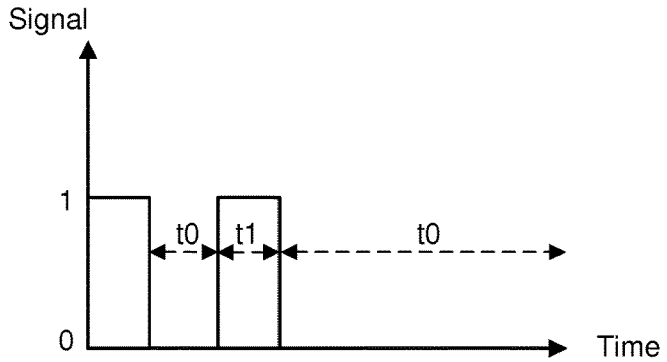
FIG. 8 shows a third time line diagram of the signal from the sensor.

FIG. 8 shows a time line diagram in which the flow of lubricant is disrupted, leading to prolonged duration of only gas being detected. In the diagram of FIG. 8, the alternation between lubricant and gas stops completely and the gas forces the lubricant out of the first conduit 7 such that a constant signal of only gas is being produced by the sensor 3. The control unit 6 may be arranged to indicate this by performing an action such as alerting the user by the user interface 13 or by restricting power outlet of the engine 1 and eventually stopping the engine 1.

Figure 9:
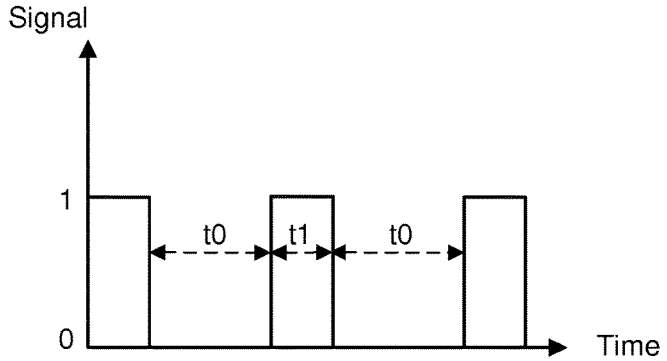
FIG. 9 shows a fourth time line diagram of the signal from the sensor.

In FIG. 9, the alternations between lubricant and oil are slower than what is determined to be acceptable, i.e. the one or both of t0 and t1 are not within their acceptable boundaries. This indicates that the flow of lubricant and/or gas past the sensor 3 is not functioning as intended which can be determined by the control unit 6 and which performs the action in response to the sensor 3 signal.

The engine 1 comprising the lubrication system according to the teachings herein is preferably be adapted for use in a power tool, such as a cut-off saw, lawn mover, chain saw, construction power tools or other similar tools suitable for being powered by an internal combustion engine.

The engine 1 may be 2-stroke or 4-stroke engine which may comprise a carburetor or fuel injection system. The throttle valve and/or the venturi may be comprised within a carburetor or fuel injector system and the first and second conduit 7, 8 may therefore be connected directly to the carburetor or fuel injection system of the engine 1.

It should be mentioned that the inventive concept is by no means limited to the embodiments described herein, and several modifications are feasible without departing from the scope of the invention as defined in the appended claims. For instance, the engine 1 may be used in other applications such as powering of vehicles.

The invention claimed is:

1. A lubricating system for an internal combustion engine, the system comprising:

a first conduit means connecting a lubricant supply source to the internal combustion engine for supplying lubricant to the internal combustion engine, a second conduit means connecting a gas supply source to the first conduit means for supplying gas to the first conduit means such that gas bubbles are formed in the first conduit means, a sensor configured to detect whether a pattern of alternating lubricant and gas is present in a certain part of the first conduit, said certain part being located downstream the connection of the second conduit means to the first conduit means, and a control unit connected to the sensor, the control unit being configured to determine, in response to the detections of the sensor, whether the lubricant is flowing through the first conduit means to the internal combustion engine in an amount to support operation of the internal combustion engine.

2. A lubricating system according to claim 1, wherein a pump is located in the first conduit means for pumping said lubricant.

3. A lubricating system according to claim 2, wherein the first conduit means comprises a check valve downstream of the pump that allows flow only in a direction from the pump toward the check valve.

4. A lubricating system according to claim 1, wherein the second conduit means is connected to a gas supply source that has a first pressure which, at operation of the system, is at least intermittently higher than a second pressure where the second conduit means is connected to the first conduit means.

5. A lubricating system according to claim 1, wherein the sensor is arranged to transmit a binary signal to the control unit, said signal varying depending on whether the gas or whether the lubricant is present in said certain part.

6. A lubricating system according to claim 5, wherein said signal is an alternating signal if lubricant is present and a constant signal if the gas is present, or vice versa.

7. A lubrication system according to claim 1, wherein the second conduit means comprises a check valve arranged to allow flow through the second conduit means only in the direction towards its connection to the first conduit means.

8. A lubricating system according to claim 1, wherein the sensor is an optical sensor or a capacitive sensor.

9. A lubricating system according to claim 1, wherein the control unit is configured to determine whether the lubricant is flowing through the first conduit means at a predetermined flow rate.

10. A lubricating system according to claim 9, wherein the user interface is arranged to alert the user that a flow rate of the lubricant is outside the predetermined flow rate.

11. A lubricating system according to claim 1, wherein a user interface is connected to the control unit for alerting a user that flow of the lubricant has stopped.

12. A lubricating system according to claim 1, wherein at least one of the first conduit means and the second conduit means includes a restriction arranged to facilitate and control formation of the gas bubbles in the first conduit means.

13. An internal combustion engine, the internal combustion engine comprising:

a lubricating system, the lubricating system comprising:

a first conduit means connecting a lubricant supply source to the internal combustion engine for supplying lubricant to the internal combustion engine, a second conduit means connecting a gas supply source to the first conduit means for supplying gas to the first conduit means such that gas bubbles are formed in the first conduit means, a sensor configured to detect whether the lubricant or whether the gas is present in a certain part of the first conduit, said certain part being located downstream the connection of the second conduit means to the first conduit means, and a control unit connected to the sensor, the control unit being configured to determine, in response to the detections of the sensor, whether the lubricant is flowing through the first conduit means to the internal combustion engine, wherein an intake of the engine comprises a throttle valve, wherein the throttle valve is positioned downstream of a venturi disposed at the intake in relation to a flow direction in the intake, and wherein the second conduit means is connected to the intake upstream of the throttle valve.

14. An internal combustion engine according to claim 13, wherein the control unit is configured to perform an action in response to determining that a flow rate of the lubricant is outside a predetermined flow rate, the action being one or several of:

indicating that the flow of the lubricant to the engine is outside the predetermined flow rate, restricting engine power output, stopping the engine.

15. An internal combustion engine according to claim 13, wherein the second conduit is connected to the intake downstream of the throttle valve, and wherein the internal combustion engine is disposed in a power tool comprising a cut-off saw, a chain saw, a hedge cutter, a lawn mower, or a trimmer.

16. An internal combustion engine, the internal combustion engine comprising:

a lubricating system, the lubricating system comprising:

a first conduit means connecting a lubricant supply source to the internal combustion engine for supplying lubricant to the internal combustion engine, a second conduit means connecting a gas supply source to the first conduit means for supplying gas to the first conduit means such that gas bubbles are formed in the first conduit means, a sensor configured to detect whether the lubricant or whether the gas is present in a certain part of the first conduit, said certain part being located downstream the connection of the second conduit means to the first conduit means, and a control unit connected to the sensor, the control unit being configured to determine, in response to the detections of the sensor, whether the lubricant is flowing through the first conduit means to the internal combustion engine, wherein the second conduit means is connected to an intake of the engine as the gas supply source.

17. A method for providing lubricant to an internal combustion engine, the method comprising:

providing the lubricant from a lubricant supply source via a first conduit means to the internal combustion engine, providing gas to the first conduit means via a second conduit means such that intermittent gas bubbles form in the first conduit means, using a sensor to detect whether the lubricant or whether the gas is present in a certain part of the first conduit means, the certain part being located downstream of a supply of the gas from the second conduit means to the first conduit means, in response to detections of the sensor, determining by a control unit connected to the sensor if the lubricant is flowing through the first conduit means to the internal combustion engine, and evacuating lubricant from the first conduit means with aid of the gas from the second conduit means if flow of the lubricant stops such that the sensor only detects the gas in the first conduit.

* * * * *